US005260537A

United States Patent [19]

Beckett

[11] Patent Number: 5,260,537

[45] Date of Patent: Nov. 9, 1993

[54] MICROWAVE HEATING STRUCTURE

[75] Inventor: D. Gregory Beckett, Oakville, Canada

[73] Assignee: Beckett Industries Inc., Oakville, Canada

[21] Appl. No.: 717,884

[22] Filed: Jun. 17, 1991

[51] Int. Cl.[5] ..... H05B 6/80

[52] U.S. Cl. ..... 219/10.55 E; 219/10.55 F; 219/10.55 R; 426/107; 426/234; 426/243; 426/113; 99/DIG. 14

[58] Field of Search ..... 219/10.55 E, 10.55 F, 219/10.55 M, 10.55 R; 426/107, 113, 234, 243; 99/DIG. 14

[56] References Cited

U.S. PATENT DOCUMENTS

| | | | |
|---|---|---|---|
| 3,219,460 | 11/1965 | Brown | 99/192 |
| 3,615,713 | 10/1971 | Stevenson et al. | 99/171 H |
| 3,845,266 | 10/1974 | Derby | 219/10.55 |
| 3,985,992 | 10/1976 | Goltsos | 219/10.55 E |
| 4,013,798 | 3/1977 | Goltsos | 426/107 |
| 4,081,646 | 3/1978 | Goltsos | 219/10.55 E |
| 4,144,438 | 3/1979 | Gelman et al. | 219/10.55 E |
| 4,196,331 | 4/1980 | Leveckis et al. | 219/10.55 E |
| 4,204,105 | 5/1980 | Leveckis et al. | 219/10.55 E |
| 4,230,924 | 10/1980 | Brastad et al. | 219/10.55 E |
| 4,268,738 | 5/1981 | Flautt, Jr. et al. | 219/10.55 E |
| 4,398,994 | 8/1983 | Beckett | 156/659.1 |
| 4,552,614 | 11/1985 | Beckett | 156/640 |
| 4,641,005 | 2/1987 | Seiferth | 219/10.55 E |
| 4,866,234 | 9/1989 | Keefer | 219/10.55 E |
| 4,904,836 | 2/1990 | Turpiu et al. | 219/10.55 E |
| 4,927,991 | 5/1990 | Wendt et al. | 219/10.55 E |
| 4,985,300 | 1/1991 | Huang | 428/332 |
| 5,006,684 | 4/1991 | Wendt et al. | 219/10.55 E |
| 5,038,009 | 8/1991 | Babbitt | 219/10.55 E |

OTHER PUBLICATIONS

A Critical Analysis and Assessment of High Power Switches (27 Jun. 1987), T. R. Burkes, Inc.

*Primary Examiner*—Bruce A. Reynolds
*Assistant Examiner*—Tu Hoang
*Attorney, Agent, or Firm*—Sim & McBurney

[57] ABSTRACT

The structure includes a layer of flexible electroconductive material normally opaque to microwave radiation and having a plurality of apertures therethrough dimensioned to permit microwave energy to pass through to the interior of the foodstuff and to produce thermal energy at the surface of the foodstuff. Both a microwave shielding effect and a combined microwave energy heating and thermal energy heating effect are obtained, enabling close control of the manner and extent of microwave cooking of the foodstuff to be obtained. The plurality of apertures comprises a first plurality of elongate discrete closed-end apertures and a second plurality of continuous apertures, each of which encloses a discrete rectangular island of the electroconductive material. The layer of flexible electroconductive material is supported by and adhered to a substrate layer of microwave energy transparent material in a multiple layer article of manufacture adapted to be formed into a packaging structure in which a foodstuff may be heated by microwave energy to an edible condition.

20 Claims, 1 Drawing Sheet

MICROWAVE HEATING STRUCTURE

FIELD OF INVENTION

The present invention relates to a novel structure for effecting heating of foodstuffs by microwave energy.

BACKGROUND TO THE INVENTION

The use of microwave energy to cook a variety of foodstuffs to an edible condition is quick and convenient. However, some foodstuffs require crispening or browning to be acceptable for consumption, which is not possible with conventional microwave cooking.

It is known from U.S. Pat. No. 4,641,005 (Seiferth), assigned to James River Corporation, that it is possible to generate thermal energy from a thin metallic film (microwave susceptor) upon exposure thereof to microwave radiation and this effect has been used in a variety of packaging structures to achieve cooking of foodstuffs with microwave energy, including achieving crispening and browning, for example, of pizza crust.

Some food products which are to be cooked by microwave energy are in the form of an outer pastry dough shell and an inner filling. An example is an apple turnover. One problem which has arisen when packages employing thin metal films to generate thermal energy to obtain crispening and browning of such products, is that there is a considerable moisture loss from the filling and sometime a spilling of filling as the shell splits open, leading to an unsatisfactory product.

In addition, certain foodstuffs are difficult to brown and crispen satisfactorily. For example, while it is possible to improve the cooking of pot pies when compared to conventional oven-cooked pot pies, by the employment of microwave energy and multiple thin films of electroconductive material in the bottom of the dish, as described in my copending U.S. patent application Ser. No. 442,153 filed Nov. 28, 1989 ("Pot Pie Dish"), the disclosure of which is incorporated herein by reference, nevertheless the resulting product does not exhibit an ideal degree of browning.

Attempts have been made to improve the overall uniformity of heating which results when thin metal film microwave susceptors are exposed to microwave radiation. One such proposal is contained in U.S. Pat. No. 4,927,991 (Wendt), assigned to The Pillsbury Company, which describes the employment of a microwave-reflective grid in combination with a thin metal film microwave susceptor. The structure is stated to achieve a more uniformly heated foodstuff by controlling surface heating and microwave transmittance.

Another approach to the microwave cooking of foodstuffs is described in U.S. Pat. No. 3,845,266 (Derby), assigned to Raytheon Company. This patent describes a utensil for microwave cooking, which is intended to be reusable in a microwave oven and is illustrated, in one embodiment, as taking the form of a slotted rigid stainless steel plate. The slotted nature of the stainless steel plate is said to achieve browning and searing of foodstuff in contact with it in a microwave oven. The stainless steel plate sits on a member of microwave transparent material, such as glass, in the cavity of a microwave oven to effect such heating.

It also has been previously suggested from U.S. Pat. No. 4,230,924 (Brastad et al) to provide microwave energy generated browning of a foodstuff from a food package which includes a flexible wrapping sheet of polymeric film having a flexible metal coating, which either may be relatively thin film or relatively thick foil and which, in either case, is subdivided into a number of individual metallic islands in the form of squares. It has been found that, while some thermal energy generation is achieved by such structures, both with the relatively thin film and the relatively thick foil, little or no shielding of microwave energy is achieved using the described relatively thick foil structure. In this latter prior art, the metal is provided in the form of discrete islands which are separated one from another, and hence the metallized portion of the substrate is discontinuous in character.

Further, there have been a variety of proposals to moderate the proportion of incident microwave energy reaching a foodstuff by using perforated aluminum foil. For example, U.S. Pat. Nos. 4,144,438, 4,196,331, 4,204,105 and 4,268,738, all assigned to The Procter & Gamble Company, disclose a microwave cooking bag formed from a laminate of two outer thermoplastic films sandwiching a perforated aluminum foil having a series of large circular apertures therethrough. While this arrangement may be useful in moderating the microwave energy entering the foodstuff, these openings are not of a size or shape which permits the generation of thermal energy, so that no surface browning can result.

Similarly, U.S. Pat. No. 3,219,460 (Brown), U.S. Pat. No. 3,615,713 (Stevenson), U.S. Pat. Nos. 3,985,992, 4,013,798 and 4,081,646 (Goltsos) describe T.V. dinner trays intended for use for microwave cooking of such foods, in which the lid is provided with apertures of varying dimension through microwave opaque materials incorporated into the lid structure to control the flow of microwave energy to the different food products in the tray. Again, the apertures are not of a size or shape to permit the generation of thermal energy.

In my prior U.S. patent application Ser. No. 650,246 filed Feb. 4, 1991 "(now U.S. Pat. No. 5,117,078)", assigned to the assignee hereof and of which is incorporated herein by reference, I have described an improved structure for the generation of thermal energy in a selected and controlled manner using flexible normally microwave-opaque electroconductive materials, for example, aluminum foil.

As described therein, a plurality of elongate apertures of appropriate dimensions is formed in the flexible electroconductive material, which results in the generation of thermal energy in the region of the apertures upon exposure of the flexible electroconductive material to microwave radiation. For the purpose of incorporation of the layer of flexible electroconductive material into a packaging structure, the layer of flexible normally microwave-opaque electroconductive material is supported on and is in adhered structural relationship with a substrate layer of microwave energy transparent material. The plurality of elongate apertures is sized and arranged in this prior art structure to generate sufficient thermal energy to effect a desired surface browning of the foodstuff while permitting sufficient microwave energy to penetrate the layer of flexible electroconductive material through the plurality of apertures into the foodstuffs to effect a desired degree of dielectric heating of the foodstuff, whereby the foodstuff may be provided in an edible condition.

This arrangement enables a much greater degree of control to be achieved over the microwave cooking of food products which are comprised of component parts which require different degrees of cooking, and, in particular those that require outer crispening or browning and yet may suffer from moisture loss, which may lead to some sogginess of product, if over-exposed to microwave energy.

The degree of thermal energy generation which can be achieved from this prior art structure is limited and, in the case of some foodstuffs, such as pre-cooked meat products, such as hot dogs, may be insufficient to provide the desired outer browning or searing effect, which providing a satisfactorily reheated product.

SUMMARY OF INVENTION

It now has been surprisingly found that a considerably enhanced heating effect can be achieved f rom a flexible normally microwave-opaque electroconductive material by combining, in the same layer, a plurality of elongate apertures through the electroconductive material and a plurality of individual islands of the electroconductive material.

In one aspect of the present invention, there is provided a multiple layer article of manufacture adapted to be formed into a packaging structure in which a foodstuff may be heated by microwave energy to an edible condition. By providing an article of manufacture which is able to be formed into a packaging structure, in accordance with the present invention, a food product may be maintained in the same structure through the multiple steps of filling, freezing, storing, shipping, retailing and then microwave reconstitution for consumption before discard.

The article of manufacture of the invention comprises a layer of flexible electroconductive material supported on a substrate layer. The layer of flexible electroconductive material has a thickness which is normally substantially opaque to microwave radiation and has a plurality of elongate apertures extending wholly through the thickness of the electroconductive material layer and effective to generate thermal energy in the plurality of apertures when the article of manufacture is exposed to microwave energy and the foodstuff is in contact with or proximate to the plurality of apertures.

The plurality of apertures comprises apertures of two types, namely a first plurality of elongate discrete closed-end apertures and a second plurality of continuous apertures, each of which encloses a discrete rectangular island of electroconductive material. The first plurality of apertures may be formed in the rectangular islands of electroconductive material. This arrangement of two different types of aperture, particularly when the first plurality of apertures is formed in the rectangular islands, achieved an enhanced level of thermal energy generation, enables a greater degree of surface browning to be achieved, as compared to a structure with the same overall aperture area but formed wholly of elongate closed-end apertures.

The plurality of apertures is sized and arranged in the layer of flexible electroconductive material to generate sufficient thermal energy to effect a desired surface browning of the foodstuff while permitting sufficient microwave energy to penetrate the layer of flexible electroconductive material through the plurality of apertures into the foodstuff to effect a desired degree of dielectric heating of the foodstuff, whereby the foodstuff may be provided in an edible condition.

The substrate layer is formed of microwave energy transparent material and is in adhered structural supporting relationship with the flexible layer of electroconductive material so that a packaging structure may be formed from the article in which the foodstuff may be positioned.

GENERAL DESCRIPTION OF INVENTION

Figure 1:
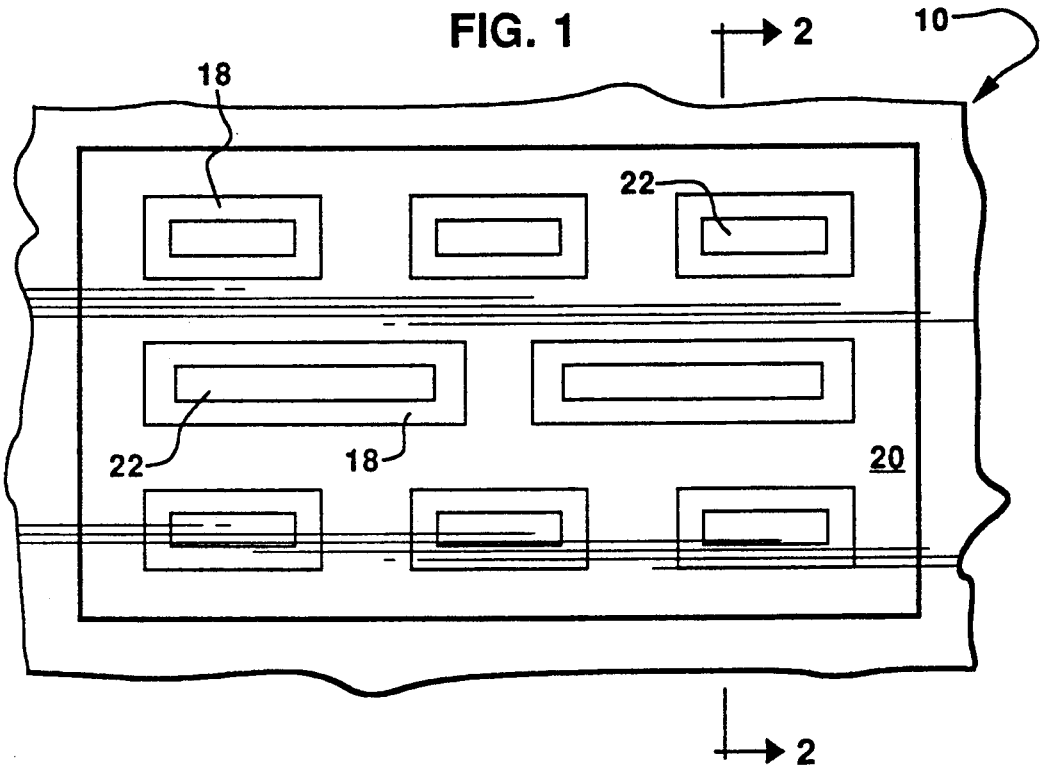
FIG. 1 is a plan view of a portion of a packaging material provided in accordance with one embodiment of the invention.
Figure 2:
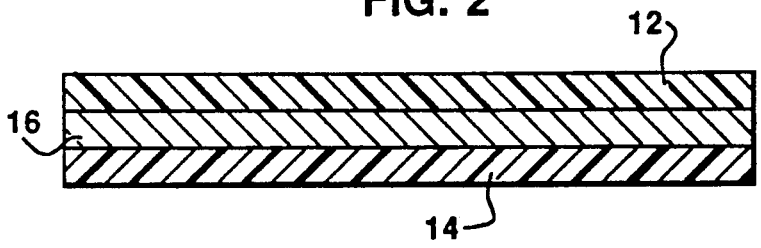
FIG. 2 is a sectional view taken on line A—A of FIG. 1.

It is generally known that electroconductive metals having a thickness above that at which a portion of the microwave radiation is converted into thermal energy become largely opaque to microwave radiation, such as aluminum of foil thickness, and this effect has been employed to achieve shielding of foodstuffs from microwave energy, in a variety of structures, such as is described above.

In the present invention, a plurality of apertures is formed through the electroconductive metal layer. In this structure, the metal or other electroconductive material shields the foodstuff from the passage of microwave energy therethrough while microwave energy is permitted to pass through the elongate apertures into the foodstuff. At the same time, a portion of the microwave energy passes through the apertures, producing an intense field, which, in turn, causes surface browning of the food.

In this way, the intensity of microwave energy reaching the foodstuff filling is considerably decreased by the shielding effect of the metal, while permitting browning and crispening of the exterior, so as to produce a cooked food product with much decreased moisture loss.

In addition, by providing the plurality of apertures in the form of a first plurality of closed-end apertures and a second plurality of continuous apertures, each of which encloses a discrete rectangular island of electroconductive material, the intensity of thermal generation which is achieved is greater than if the plurality of elongate apertures providing the same area of aperture opening were all closed-end. It is preferred for the maximum thermal energy generation to provide the closed-end elongate apertures in the rectangular islands of electroconductive material. One closed-end elongate aperture may be provided in some or all of the rectangular islands, or a plurality of closed-end elongate apertures may be provided in some or all of the rectangular islands.

The proportion of incident microwave energy passing through the apertures into the foodstuff may be increased by making the apertures wider, while making the apertures longer and narrower increases the intensity of the surface heating. By appropriate choice of individual aperture size, number and form of apertures, heating of the foodstuff by microwave energy is controllable to a considerable degree.

As noted above, several structures have been described which employ circular or similarly geometrically-shaped openings in shielding structures. However, the different geometry of opening employed in the present invention produces a dramatically-different result, namely that the present invention enables thermal energy to be produced for surface browning and crispening while achieving shielding of the foodstuff from exposure to the full effect of the microwave energy.

This result enables a much greater degree of control to be achieved over the microwave cooking of food products which are comprised of component parts which require different degrees of cooking, and, in particular, those that require outer crispening or browning and yet may suffer from moisture loss, which may lead to some sogginess of the product, if over-exposed to microwave energy. Examples of foodstuffs which may be cooked or reheated for consumption with advantage by microwave energy, using the structure of the present invention, are french fries, pot pies, pizzas, burritos and apple turnovers. In addition, the intensified heating which is achieved is suitable for rapid reheating of pre-cooked meat products for consumption with outer browning, such as hot dogs.

In the present invention, there is employed a layer of flexible electroconductive material which is of a thickness which is normally opaque to microwave energy, and which is supported by and adhered to a layer of varies with the material chosen. Generally, the layer has a minimum thickness of about 1 micron. The flexible electroconductive material layer conveniently may be provided by aluminum foil having a thickness of about 1 to about 15 microns in thickness, preferably about 3 to about 10 microns, typically about 7 to about 8 microns. Other suitable electroconductive materials include stainless steel, copper and carbon.

The layer of electroconductive material is provided with a plurality of two different types of thermal energy-generating apertures therethrough. The number, size, form and relative location of the elongate apertures depends on the size of the foodstuff and the degrees of internal cooking and of surface browning desired.

Each elongate, closed-end aperture is elongate and may comprise a single opening formed into a spiral or other pattern so as to have the physical appearance of a plurality of apertures. Each such elongate closed-end aperture generally is no shorter than about 1.75 cm and may extend for any desirable length. An aperture generally varies in width from about 1 mm to about 2 cm, provided that the length is greater than the width. In general, more surface heating of the foodstuff is achieved as the apertures become longer and narrower. As the apertures become wider, more microwave energy is able to pass through into the interior of the foodstuff, so that less intense heat generation and less shielding of the microwave energy from penetration to the foodstuff result.

Each of the continuous apertures has longitudinal length and width parameters corresponding to those of the closed-end apertures and further each defines an island of electroconductive material which is rectangular in shape, including square. Each of the islands may comprise an area ranging from about one-quarter square inch to about 10 square inches, preferably about 1 to about 8 square inches.

A series of continuous apertures may be contiguous, thereby providing a single large closed-end aperture having a plurality of rectangular islands of electroconductive material formed therein. A plurality of such large closed-end apertures may comprise said first plurality of apertures.

In a preferred structure, a plurality of closed-end apertures is formed in the corresponding) plurality of rectangular islands of electroconductive material, extending in the direction of the longitudinal dimension thereof, with a plurality of such islands being provided in longitudinally-aligned form in a plurality of large closed-end apertures. In addition, more than one closed-end aperture may be provided in one or more of the rectangular islands.

Within the overall pattern of apertures, a metal spacing of at least about 0.5 mm is maintained between individual apertures.

Where a plurality of individual apertures of the two types is employed, the apertures may be equally dimensioned and equally spaced apart, which produces an even and enhanced degree of heating over the expanse of the continuous layer of electroconductive material containing such plurality of apertures. However, the dimensions and spacing and type of individual ones or groups of the plurality of apertures may be varied and may be located only in selected portions of the expanse of the continuous layer of electroconductive material, so as to achieve differential degrees of heating, differential ratios of internal and surface heating and shielding only, as desired, in various locations of the expanse of the layer of electroconductive material. The number, location and size of the apertures may be such as to achieve any desirable combination of microwave energy reflected, transmitted and converted into thermal energy for the packaging structure, both in the overall structure and locally within the structure.

Another alternative which may be used, depending on the result which is desired, is to provide, in some or each aperture, an electroconductive material of sufficient thinness that a portion of microwave energy incident thereon is converted to thermal energy, as described in U.S. Pat. No. 4,641,005 (Seiferth), referred to above, so as to augment the browning effect which results from the aperture itself.

Similar augmentation is possible using the structure described in International Patent application No. CA90/00355 filed Oct. 18, 1990 ("DOT-MET"), assigned to the assignee hereof and the disclosure of which is incorporated herein by reference.

Using the guidelines above, it should be possible for a person skilled in the art to manipulate the number, size and type of apertures in the layer of flexible normally microwave-opaque electroconductive material to provide the required degree and type of heating for any given foodstuff to achieve the optimum cooked condition for consumption.

The elongate apertures may be formed in the continuous flexible electroconductive material layer in any convenient manner, depending on the nature of the electroconductive material and the physical form of the electroconductive material.

For example, with the electroconductive material being a self-supporting aluminum foil layer, the apertures may be stamped out using suitable stamping equipment, and then adhered to the substrate layer. Alternatively and more preferably, with the electroconductive material being aluminum foil or other etchable metal supported on a polymeric film, such as by laminating adhesive, the apertures may be formed by selective demetallization of metal from the polymeric film using, for example, the procedures described in U.S. Pat. Nos. 4,398,994 and 4,552,614 and copending U.S. patent application Ser. No. 655,022 filed Feb. 14, 1991 ("DE-MET V"), all assigned to the assignee hereof and the disclosures of which are incorporated herein by reference, wherein an aqueous etchant is employed to remove aluminum from areas unprotected by a pattern of etchant-resistant material. Another possible procedure involves the use of ultrasonic sound to effect such selective demetallization.

Following such selective demetallization, a polymeric lacquer or other detackifying material may be applied over the exposed surfaces of laminating adhesive in the selectively demetallized electroconductive layer to inhibit adjacent layers from adhering to one another a result of exposed adhesive in the apertures, when a web of such selectively demetallized material is rolled up, as is often the case prior to formation of the desired packaging material.

For the purpose of providing a packaging material, the apertured flexible electroconductive material layer is supported on and adhered to a continuous substrate of suitable microwave-transparent substrate, which generally is microwave-transparent stock material which does not deform upon the generation of heat from the layer of electroconductive material during exposure of a foodstuff in the packaging material to microwave energy.

The flexible layer of electroconductive material may conveniently be laminated to a paper or paperboard substrate as the stock material, which may be semi-stiff or stiff, with the packaging material being formed from the resulting laminate. Similarly, the layer of flexible electroconductive material may be laminated to a heat-resistant polymeric material substrate as the stock material to provide the article of manufacture. The layer of flexible electroconductive material also may be laminated between two outer paper or paperboard polymeric material layer, and a paper or paperboard layer. In these structures, the polymeric material layer, such as polyester or polyethylene, may be flexible or rigid.

Alternatively, the flexible layer of electroconductive material may be laminated to a single or between two rigid thermoformable polymeric material layer(s), by adhesive bonding, and the laminate may be thermoformed to the desired product shape.

The multiple layer article of manufacture of the present invention may be incorporated into a variety of packaging structures for housing foodstuffs where the generation of thermal energy during microwave heating is desired. The structures may include a variety of trays and dishes, such as disposable pot pie dishes and rigid reusable trays or dishes, a variety of bag structures, such as french fry bags, hot dog bags and bags for cooking crusty filled products, for example, an apple turnover, a variety of box structures, such as pizza boxes, and domestic ware, such as reusable or disposable plates and dishes.

As noted above, one of the significant advantages of the structure of the present invention is the ability to employ the structure in manufacturing, retailing and packaging structure generally conforms to the physical three-dimensional form of the foodstuff, whether in the form of relatively stiff or rigid dish or tray, or in the form of a flexible bag structure, to enable the desired microwave heating of the foodstuff to be achieved.

It may be desirable to provide a layer of release material on food-contacting surfaces of the structure, to inhibit sticking of food to such surfaces.

DESCRIPTION OF PREFERRED EMBODIMENTS

Referring to the drawings, a multiple layer structure 10 comprises outer layers of polymeric film 12 opaque thickness, such as aluminum foil. The metal layer 16, is patterned to provide a plurality of rectangular metal islands 18 formed in a large aperture 20. Each of the rectangular metal islands 18 has an elongate closed-end aperture 22 formed therein.

This arrangement of islands and apertures produces a more intense generation of thermal energy from incident microwave energy as the same open area provided by a plurality of closed-end elongate apertures.

EXAMPLE

On a polymeric film-substrate, there were provided two structures, one comprising 12 parallel strips of aluminum foil of thickness about 7 to 8 microns, each 7 inches long and ¼ inch line joined together by a further strip of aluminum foil at each of the ends of the strips and another without such additional strips.

The two structures were laminated to cardboard and the two laminates were exposed to microwave radiation. The one structure with the strips connected exhibited considerably decreased charring as compared to the structure with the strips not so connected.

SUMMARY OF DISCLOSURE

In summary of this disclosue, the present invention provides a novel microwave energy cooking structure involving microwave opaque materials and different forms of aperture to achieve intensified generation of thermal energy. Modifications are possible within the scope of this invention.

What I claim is:

1. A multiple layer article of manufacture, for formation into a packaging structure for heating a foodstuff by microwave energy to an edible condition comprising:

a layer of flexible electroconductive material supported on a substrate layer, said layer of flexible electroconductive material having a thickness which is normally substantially opaque to microwave radiation and having a plurality of apertures extending wholly through the thickness of said electroconductive material layer and effective to generate thermal energy in said plurality of apertures when said article is exposed to microwave energy and the foodstuff is in contact with or proximate to said plurality of apertures, said plurality of apertures comprising:

a first plurality of elongate discrete closed-end apertures, and a second plurality of continuous apertures, each of which encloses a discrete rectangular island of said electroconductive material, said plurality of apertures being sized and arranged in said layer of flexible electroconductive material to generate sufficient thermal energy to effect a desired surface browning of the foodstuff while permitting sufficient microwave energy to penetrate said layer of flexible electroconductive material into the foodstuff to effect a desired degree of heating of the foodstuff, whereby the foodstuff may be provided in an edible condition, said substrate layer being formed of microwave energy transparent material and being in adhered structural supporting relationship with said flexible layer of electroconductive material to permit a package structure be formed from said article in which the foodstuff is positioned.

2. The article of claim wherein said layer of flexible electroconductive material has a thickness of at least about 1 micron.

3. The article of claim 1 wherein said layer of electroconductive material is aluminum foil having a thickness of from about 1 to about 15 microns.

4. The article of claim 3 wherein said aluminum foil has a thickness of about 3 to about 10 microns.

5. The article of claim 3 wherein each said elongate closed-end aperture has a width of at least about 1 mm and a length of at least about 1.75 cm.

6. The article of claim 5 wherein each said rectangular islands is sized from about ¼ to about 10 square inches.

7. The article of claim 6 wherein each of said rectangular islands is sized from about 1 to about 8 inches.

8. The article of claim 6 wherein at least some of said plurality of elongate closed-end apertures is formed in said plurality of rectangular islands.

9. The article of claim 8 wherein at least some of said plurality of rectangular islands have more than one of said plurality of closed-end apertures therein.

10. The article of claim 8 wherein said substrate layer is formed of microwave transparent structural stock material.

11. The article of claim 8 wherein said substrate layer is formed of paper or paperboard.

12. The article of claim 11 wherein said substrate layer is provided on one side of the layer of electroconductive material and a polymeric film is provided on the other.

13. The article of claim 11 wherein said substrate layer is provided on both sides of the layer of electroconductive material.

14. The article of claim 9 wherein said layer of electroconductive material is laminated between outer layers of polymeric material.

15. The article of claim 14 wherein at least one of said polymeric material layers is formed of rigid moldable material.

16. The article of claim 1 wherein said substrate layer is a polymeric film layer to which said layer of electroconductive material is adhered by laminating adhesive.

17. The article of claim 16 wherein said plurality of apertures in said layer of electroconductive material is formed therein by selective demetallization.

18. The article of claim 17 wherein said layer of electroconductive material is coated with a layer of detackifying material for said laminating adhesive following said selective demetallization.

19. The article of claim 17 wherein a layer of food release material is provided on food-contacting areas of said polymeric film layer on an opposite side thereof from that to which said electroconductive material is adhered.

20. The article of claim 1 in combination with said foodstuff packaged therein with said plurality of apertures located in thermal energy-generating relationship with said foodstuff.

* * * * *